US006092737A

United States Patent [19]

Bosch et al.

[11] Patent Number: 6,092,737

[45] Date of Patent: Jul. 25, 2000

[54] DIRECT ACTING FUEL INJECTOR

[75] Inventors: Russell Harmon Bosch, Gaines; Richard G. Grundman, Coopersville; Michael James Seino, Flushing, all of Mich.

[73] Assignee: General Motors Corporation, Detroit, Mich.

[21] Appl. No.: 09/241,720

[22] Filed: Feb. 2, 1999

[51] Int. Cl.[7] ..... F02M 41/16

[52] U.S. Cl. ..... 239/96; 239/88

[58] Field of Search ..... 239/88, 91, 96, 239/124

[56] References Cited

U.S. PATENT DOCUMENTS

| | | | |
|---|---|---|---|
| 3,680,782 | 8/1972 | Monpetit et al. | 239/96 |
| 4,826,080 | 5/1989 | Ganser | 239/88 |
| 4,946,106 | 8/1990 | Turchi et al. | 239/96 |
| 4,993,636 | 2/1991 | Taue et al. | 239/88 |
| 5,011,082 | 4/1991 | Ausiello et al. | 239/96 |
| 5,127,583 | 7/1992 | Taue | 239/124 |
| 5,244,150 | 9/1993 | Ricco et al. | 239/96 |
| 5,246,165 | 9/1993 | De Matthaeis et al. | 239/96 |
| 5,395,048 | 3/1995 | Ricco et al. | 239/96 |
| 5,472,142 | 12/1995 | Iwanage | 239/96 |
| 5,671,715 | 9/1997 | Tsuzuki | 239/96 |
| 5,860,597 | 1/1999 | Tarr | 239/96 |

*Primary Examiner*—Lesley D. Morris
*Assistant Examiner*—Christopher S. Kim
*Attorney, Agent, or Firm*—Timothy D. MacIntyre

[57] ABSTRACT

An electrically controlled hydraulic actuated fuel injector wherein the amount of return fuel flow is substantially reduced without adversely affecting injection valve operation. An improved control valve armature valve disk of faster acting construction is also included. In one embodiment, dual pressurizing passages of differing diameters provide lower total fuel flow to a control chamber than the outflow through a depressurizing passage controlled by a control valve. Upon full opening of the injection valve, all return fuel flow is supplied to the control chamber through the smaller pressurizing passage, thereby reducing the requirement for pressure fuel flow. Upon closing of the control valve, cutting off discharge through the depressurizing passage, both of the dual pressurizing passages help fill the control chamber to quickly close the injection valve. The improved control valve armature is a small magnetically responsive disk fixed to a metal guide shim having a periphery clamped in the injector housing. Integral fingers of the shim are fixed to the disk, guiding its opening and closing motion free from rubbing on the housing. The fingers lie near the periphery of the shim and disk, allowing room for fuel flow between the disk and an associated solenoid to which the disk is attracted when the control valve is open. Hydraulic resistance to closing of the control valve is thus reduced.

10 Claims, 4 Drawing Sheets

DIRECT ACTING FUEL INJECTOR

TECHNICAL FIELD

This invention relates to direct acting fuel injectors for the intermittent injection of fuel at high pressure directly into engine combustion chambers.

BACKGROUND OF THE INVENTION

It is known in the art relating to engine fuel injectors to provide high pressure injection of fuel directly into the cylinder compressed air charge of a diesel or gasoline engine. So-called accumulator injectors fed with high pressure fuel from a common rail are among those used for this purpose. U.S. Pat. No. 4,826,080 Ganser discloses one form of prior injector for such purpose in which a diaphragm mounted solenoid armature drives a control valve that initiates opening and closing of an injection valve. The injection valve is closed and opened by varying fuel pressure in a control chamber through opening and closing of a depressurizing orifice by the control valve while the control chamber is being supplied through a separate aligned pressurizing orifice. Control of the rates of opening and closing of the injection valve is provided by proper selection of the orifice diameters and other parameters.

One result of this method of electrically controlled hydraulic actuation is the recirculation of return fuel discharged from the depressurizing passage during open periods of the injection valve. Because return fuel flow through the two passages continues until the control valve is again closed, additional high pressure fuel beyond that needed for fuel injection must be pumped for valve actuation purposes requiring larger fuel pump and energy costs. The size and mass of the prior solenoid mounted armature also adds to the energy use and cost.

SUMMARY OF THE INVENTION

The present invention provides an improved arrangement for electrically controlled hydraulic actuation of an injector fuel injection valve wherein the amount of return fuel flow is substantially reduced without adversely affecting injection valve operation. An improved control valve armature valve disk of lighter and faster acting construction is also provided.

The hydraulic actuation arrangement involves dual pressurizing passages of differing diameters providing lower total flow to the control chamber than the outflow through the depressurizing passage controlled by the control valve. The dual passages feed different subchambers of the control chamber formed upon full opening of the injection valve by engagement of a piston portion containing the dual orifices with a cylinder portion containing the depressurizing passage. Return flow is then limited to that passing through the smaller of the pressurizing orifices, resulting in a reduction of return fuel pumping while holding the injection valve open. Upon closing of the control valve, cutting off discharge through the depressurizing passage, both of the dual pressurizing passages help fill the control chamber to quickly close the injection valve.

The improved control valve armature is a small magnetically responsive disk fixed to a metal guide shim having a periphery clamped in the injector housing. Integral fingers of the shim are fixed to the disk, guiding its opening and closing motion free from rubbing on the housing. The fingers lie near the periphery of the shim and disk, allowing room for fuel flow between the disk and an associated solenoid to which the disk is attracted when the solenoid is energized and the control valve is open. Hydraulic resistance to closing of the control valve is thus reduced.

These and other features and advantages of the invention will be more fully understood from the following description of certain specific embodiments of the invention taken together with the accompanying drawings.

DESCRIPTION OF THE PREFERRED EMBODIMENT

Figure 1:
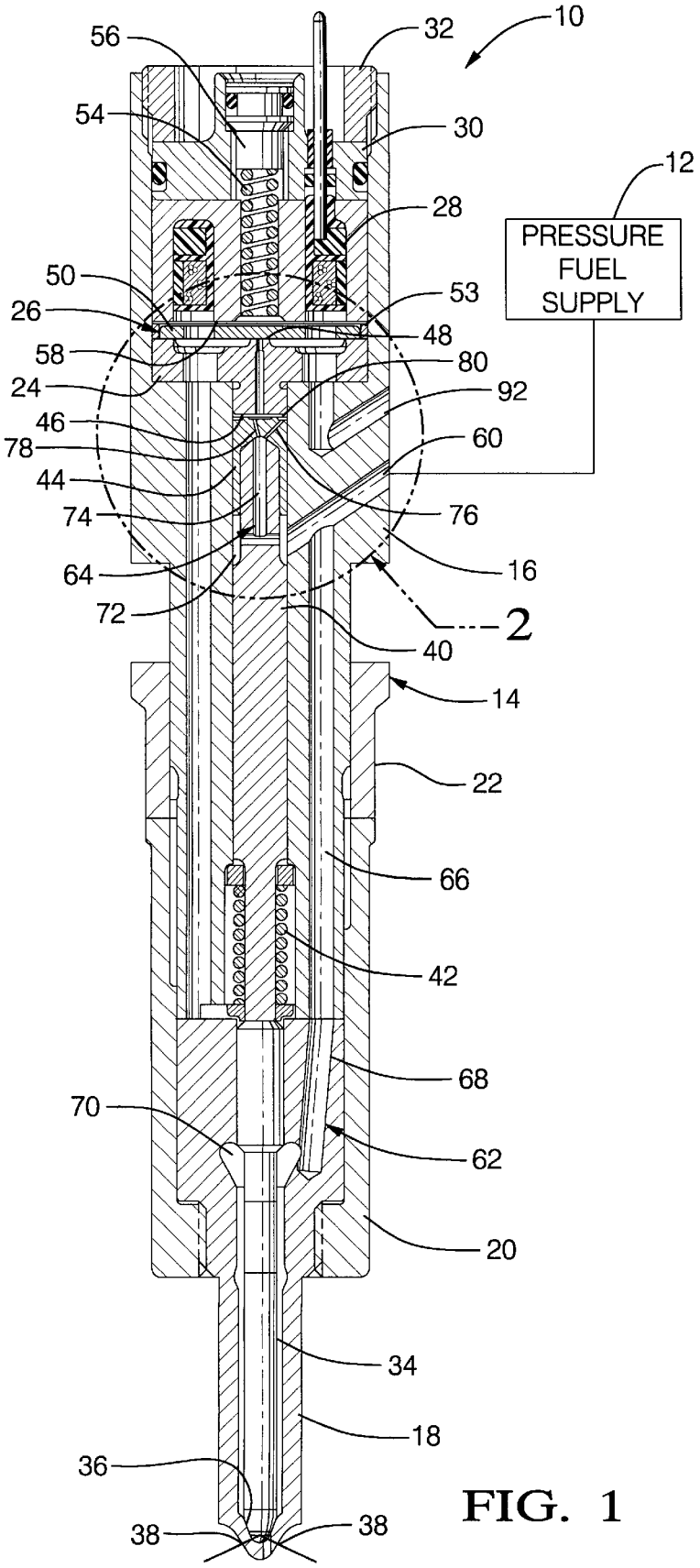
FIG. 1 is a cross-sectional view of a direct injection diesel fuel injector according to the invention.

Referring now to the drawings in detail, numeral 10 generally indicates a direct injection diesel fuel injector. Injector 10 is supplied with high pressure fuel from a common rail or manifold fed by a high pressure fuel pump connected with a fuel supply tank, all of which are indicated by box 12 labeled "pressure fuel supply". Injector 10 comprises a housing 14 including a body 16 having a spray tip 18 secured on one end by a nut 20. A clamp ring 22 is provided for clamping the injector in the engine. In a recess at another end of the body are an orifice plate 24, armature assembly 26, solenoid assembly 28 and cover 30, retained by a ring nut 32.

The spray tip 18 includes an axial bore in which a needle valve 34 is reciprocably received to act as an injection valve. Valve 34 has a conical end that seats on an injection valve seat 36 formed in one end of the spray tip and controlling fuel flow through one or more spray orifices 38 cut through the end of the spray tip.

The body 16 has an axial bore reciprocably receiving a control piston 40, one end of which always engages the needle valve 34. A needle valve spring 42 in the body 16 acts through a collar against the needle valve 34 to bias it toward the injection valve seat 36. An opposite end of the control piston includes a cap 44 which is spaced a small distance from the orifice plate 24 when the injection valve is closed, as will be subsequently further described.

The orifice plate includes an inner end 46 facing the cap 44 and an outer end having an annular control valve seat 48.

The armature assembly includes a small diameter valve disk 50 fixed to a thin flexible guide shim 52 (FIGS. 8 and 9) to be subsequently further described. The guide shim 52 protrudes radially beyond the disk 50 and is clamped between a spacer ring 53 seated on the passage plate 24 and the solenoid assembly 28. The valve disk is thus positioned for axial motion between the solenoid assembly 28 and the control valve seat 48 without rubbing on the inner side of the spacer ring 53. An armature spring 54 seated against a screw 56 in the cover 30 engages the control valve disk 50, biasing it toward the control valve seat 48. The solenoid assembly 28 has a flat lower wall 58 toward which the solenoid, when energized, attracts the valve disk 50 away from the control valve seat 48.

The injector body 16 includes an inlet port 60 which receives high pressure fuel from the pressure fuel supply 12 and directs it internally into a fuel injection circuit 62 and a fuel control circuit 64. The fuel injection circuit 62 includes inlet passages 66, 68 leading to an annular cavity 70 surrounding the needle valve 34. Cavity 70 connects via clearance between the needle valve 34 and the spray tip 18 with the injection valve seat 36, which connects with the orifices 38.

Figure 2:
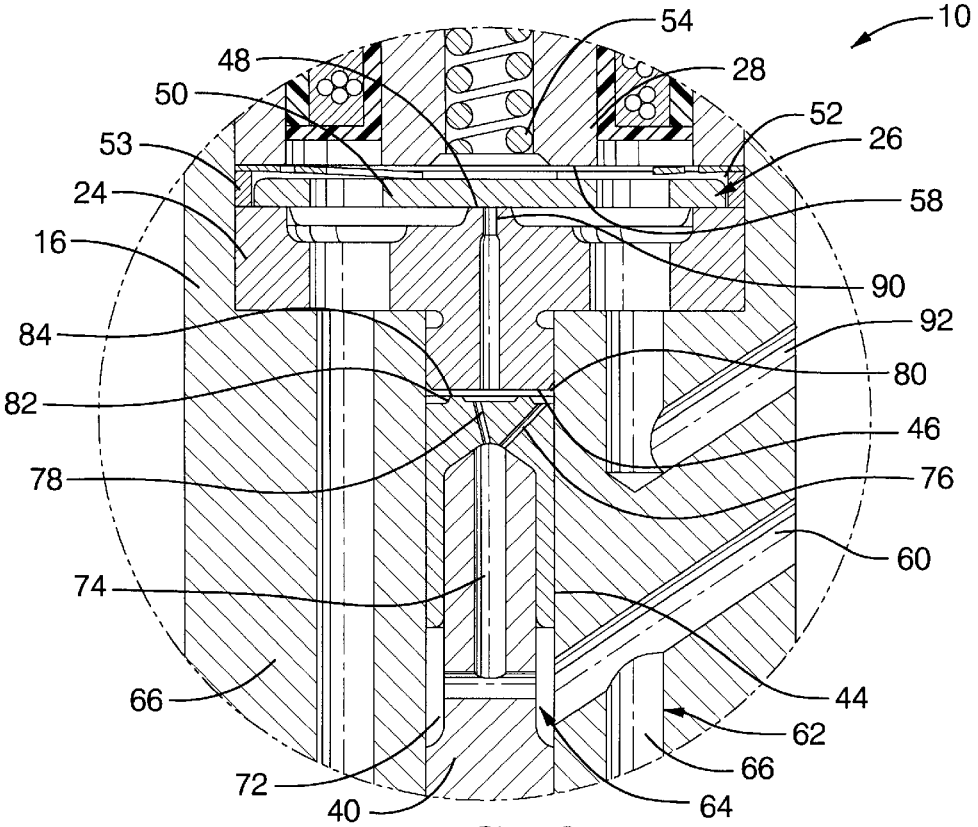
FIG. 2 is an enlarged cross-sectional view of the portion within circle 2 of FIG. 1 showing the control valve in the closed position.
Figure 3:
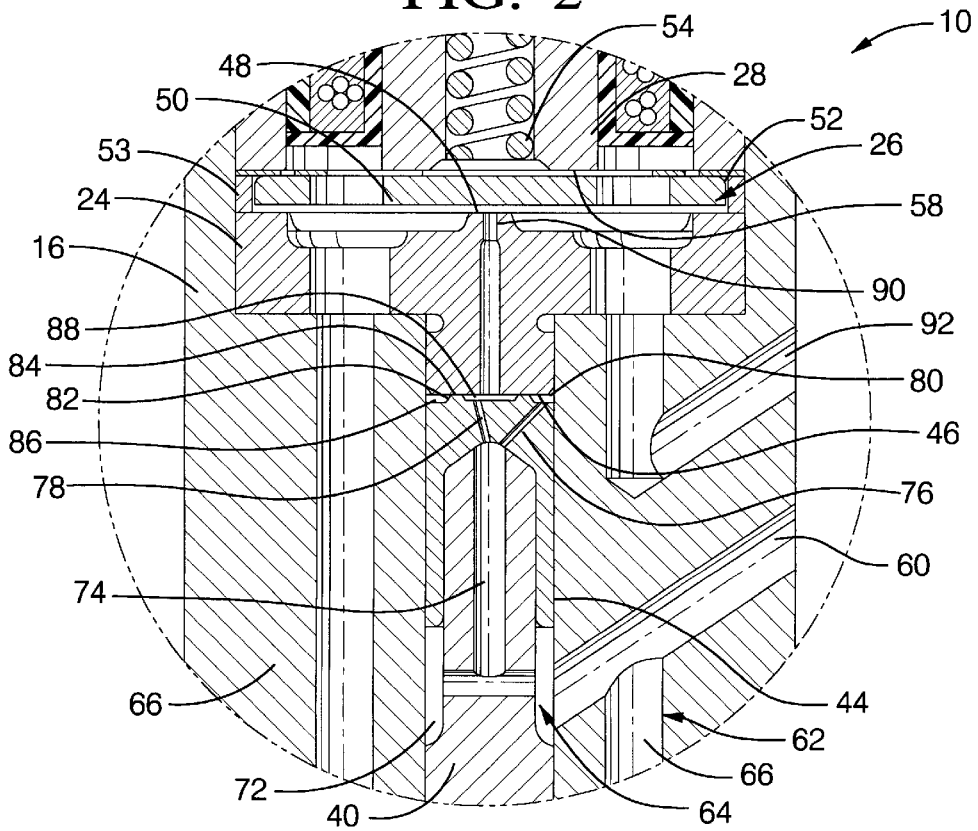
FIG. 3 is a view similar to FIG. 2 but with the control valve in the open position.

The control circuit 64 includes an annular volume 72 connecting with internal passages 74 opening through the outer end of the control piston 40 and closed by the cap 44. As is best shown in FIG. 2, the cap includes first and second pressurizing passages 76, 78 arranged for parallel flow and connecting the passages 74 with a control chamber 80 formed between the control piston cap 44 and the inner end 46 of the passage plate 24. The cap 44 has a raised circular divider 82 having an annular end 84. The divider 82 engages the orifice plate 24 at its inner end 46 when the injection valve is open, separating the control chamber into first and second subvolumes 86, 88 as shown in FIG. 3. The first pressurizing passage 76 connects with the first (outer) subvolume 86 which annularly surrounds the divider 82. The second pressurizing passage 78 connects with the second (inner) subvolume 88 which lies within the divider 82.

The orifice plate 24 includes an axially aligned passage including a depressurizing passage 90 which connects the control valve seat 48 with the control chamber 80, or with only the second subvolume 88 when the injection valve is open. A volume surrounding the control valve seat 48 connects with return fuel passages 92 which, in use, are connected to the fuel supply tank of pressure fuel supply 12 for reusing discharged return fuel.

The desired operation of the injection valve is to open the valve at a controlled rate but to close the valve as quickly as possible at the end of each injection event. This requires proper sizing of the pressurizing and depressurizing passages together with other parameters that must be determined for each injector application. In general, however, the first pressurizing passage 76 is made larger than the second pressurizing passage 78 and smaller that the depressurizing passage 90. In particular, the depressurizing passage must be sized to pass, when it is open, a greater flow of fuel from the control chamber 80 than the total flow of fuel into the control chamber through the dual pressurizing passages 76, 78.

In operation, high pressure fuel is continuously delivered through the inlet port 60 to both the fuel injection circuit 62 and the control circuit 64 of the injector 10. The full fuel pressure entering the annular cavity 70 acts axially against the area of the needle injection valve 34 that is radially outside of the injection valve seat 36 and urges the needle valve 34 in an opening direction against the bias of needle valve spring 42. However, when the solenoid 28 is deenergized so the needle injection valve 34 is closed, the opening motion is opposed by the full fuel pressure in the control chamber acting against the distal end of the control piston 40 which, being of greater area than the needle valve, engages the needle valve 34 and holds it on its seat 36. The control piston 40 is then spaced at a small distance from the inner end 46 of the passage plate as seen in FIG. 2.

Upon energizing of the solenoid 28, the control valve disk 50 is attracted toward the solenoid and away from the control valve seat 48, thereby allowing fuel to flow at a predetermined rate out of the control chamber 80 for return to the fuel tank. Pressure fuel fed to the control chamber 80 through the smaller pressurizing passages 76, 78 flows at a slower rate, so that the control chamber pressure quickly drops and the full fuel pressure acting against the needle valve 34 opens the needle valve to a fully open position. The annular end 84 of the divider 82 then engages the inner end 46 of the passage plate, dividing the control chamber into an outer first subvolume 86 and an inner second subvolume 88 as seen in FIG. 3. The inner second subvolume 88 is then exclusively connected with the depressurizing passage 90 while the outer subvolume 86 is then cut off from such connection. Thus, only the smaller second pressurizing passage 78 feeds return fuel through the depressurizing orifice 90 while flow through the larger first pressurizing orifice 76 is cut off. The amount of return fuel pumped through each injector of an engine when their respective injection valves are open is thus substantially reduced.

Deenergizing of the solenoid 28, allows the armature spring 54 to again seat the control valve disk 50 against the control valve seat 48, which cuts off return fuel flow through the depressurizing passage 90. Flow through the smaller second pressurizing passage 78 then pressurizes the second subvolume 88, unseating the control piston 40 from the valve disk inner end 46 and allowing flow through both dual passages 76, 78 to quickly fill the control chamber 80 and force the needle valve back to its closed position against the injection valve seat 36.

Figure 4:
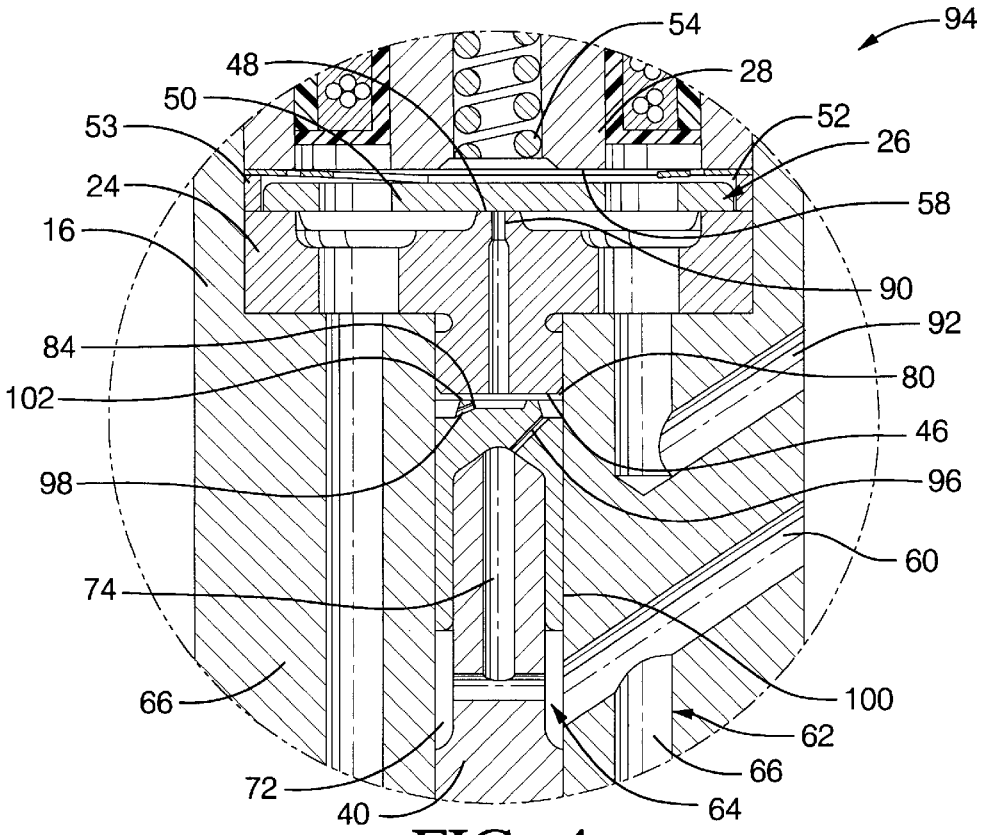
FIG. 4 is a view similar to FIG. 2 but showing an alternative embodiment with the control valve in the closed position.
Figure 5:
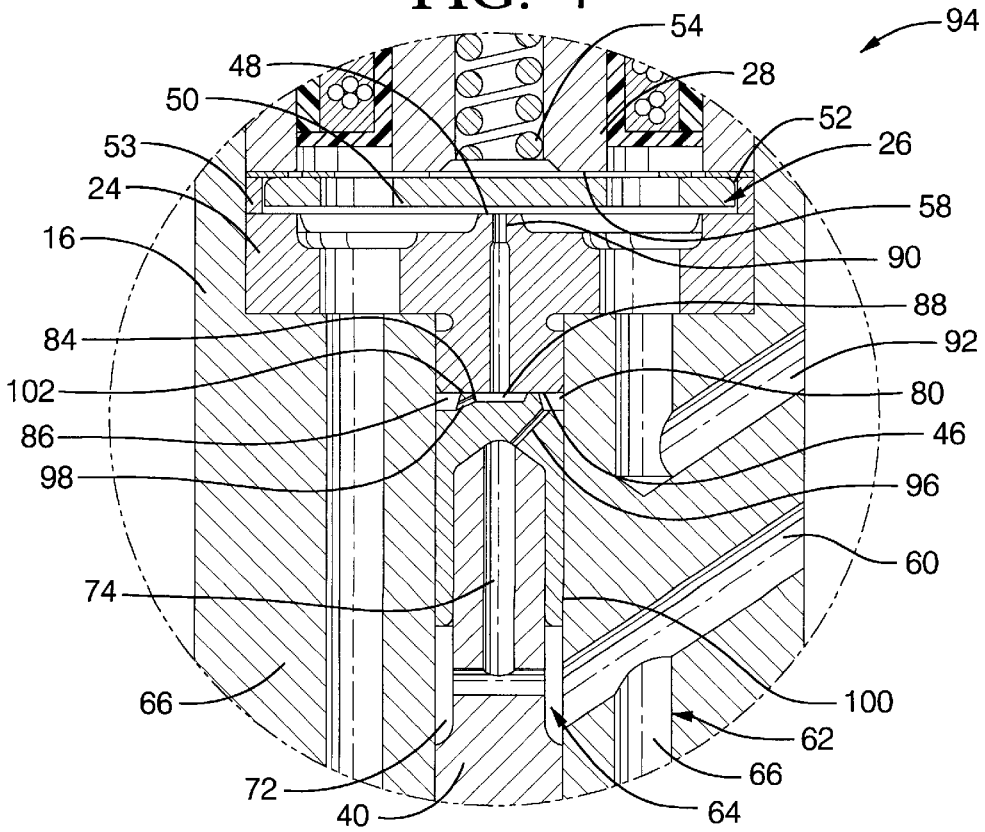
FIG. 5 is a view similar to FIG. 3 but showing the alternative embodiment with the control valve in the open position.

FIGS. 4 and 5 illustrate the structure and operation of an alternative embodiment of injector generally indicated by numeral 94. Injector 94 is generally similar to injector 10 previously described, the differences in injector 94 being shown in the selected figures wherein like numerals indicate like parts. Injector 94 provides dual first and second pressurizing passages 96, 98 arranged in series, rather than parallel as in the first embodiment. First pressurizing passage 96 extends through the control piston cap 100 as before from the internal passage 74 to the outer portion or first subvolume 86 of the control chamber 80. However, the second pressurizing passage 98 extends through the divider 102 between the inner and outer portions or subvolumes 86, 88.

In operation of injector 94, energizing of the solenoid 28 opens the depressurizing passage 90, allowing fuel discharge from the control chamber 80 with fuel inflow through the first pressurizing passage 96. When the divider 102 engages the inner end 46 of the passage plate 24, dividing the control chamber 80 into outer and inner portions, i.e. subvolumes 86, 88, return fuel flow must pass through both first and second passages 96, 98 in series to reach the depressurizing passage 90. Thus, the return fuel flow is again restricted to that which will flow through the smaller passage 98 that extends through the divider 102.

Various other arrangements of dividers and passages may be envisioned for feeding a control chamber through series or parallel orifices located in the piston, orifice plate or body of the injector in accordance with the broader aspects of the present invention which it is intended to claim herein. It should be noted that orifices as referred to in the specification and claims refer to restricted passages which may be formed by one or more components. Thus, an orifice may comprise a small drilled or otherwise formed opening or passage, or it could take the form of a groove in one component which engages another component to close the open side of the groove and form a restricted passage through the groove.

Figure 6:
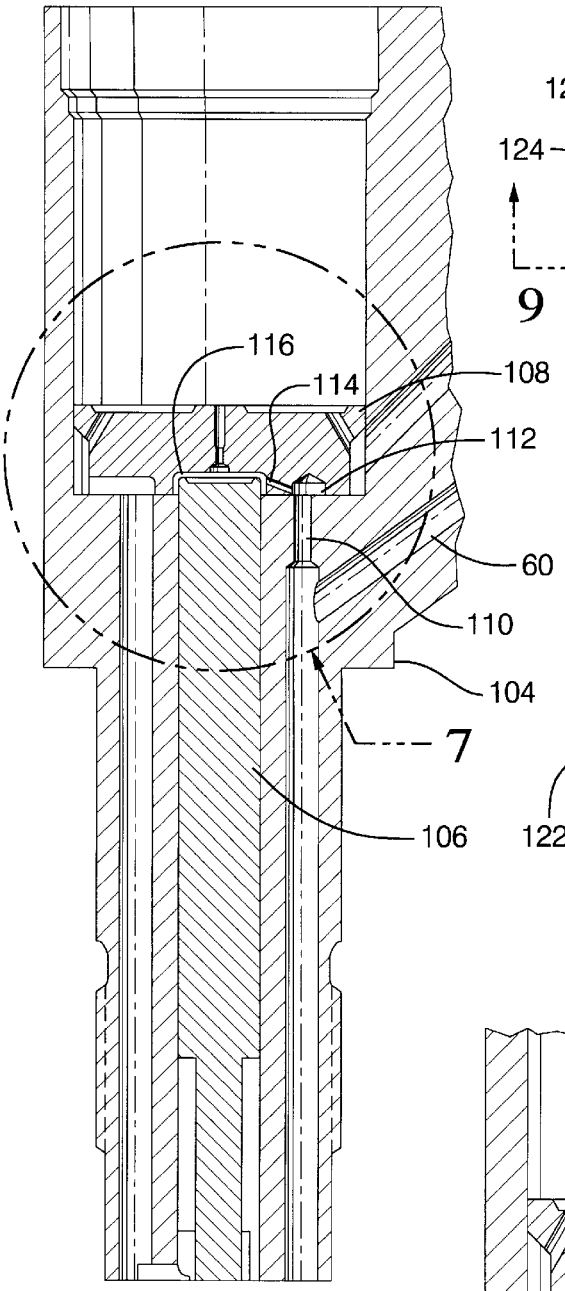
FIG. 6 is a cross-sectional view of the assembled valve body, orifice plate and control piston of another embodiment.
Figure 7:
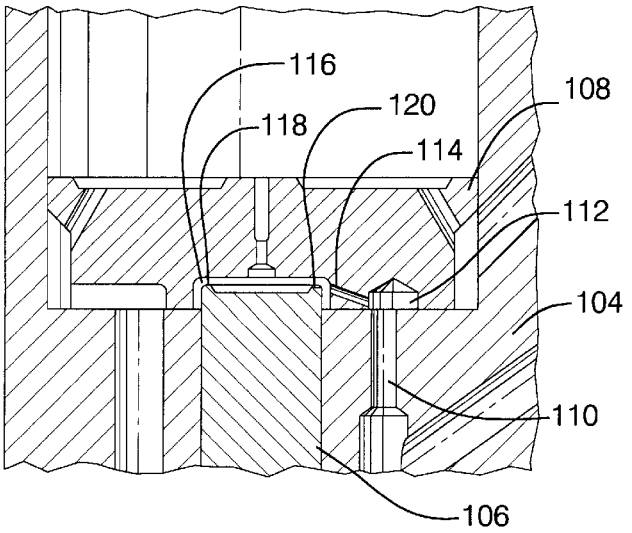
FIG. 7 is an enlarged view of the circled portion of FIG. 6 showing the control chamber in the maximized volume condition.

For example, FIGS. 6 and 7 show the assembled body 104, control piston 106 and passage plate 108 only of another alternative embodiment of injector according to the invention. The inlet port 60 directs high pressure fuel through a passage 110 to a recess 112 in the orifice plate 108 from which it flows through a larger first pressurizing passage 114, in the form of an opening or passage, to a control chamber 116 in the passage plate 108. The control piston 106 has on its end a peripheral raised rim 118 in which a small groove 120 is formed. When the control piston 106 engages the orifice plate 108 upon opening of the injection valve, not shown, the rim 118 acts as a divider and the groove 120 becomes a smaller second pressurizing orifice in series with the first pressurizing orifice 114. Return fuel flow thus must pass through both passages 114, and groove 120 and is limited by the size of the smaller orifice 120. Operation of the injector components is otherwise similar the embodiments previously discussed.

Figure 8:
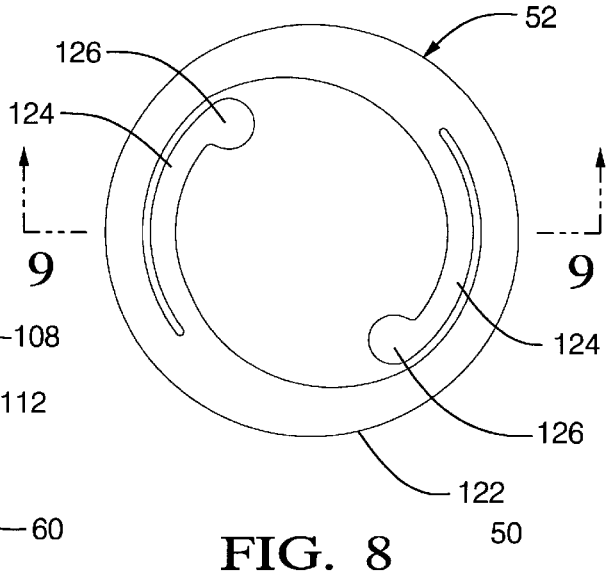
FIG. 8 is a plan view of an improved guide shim for use in an injector according to the invention.
Figure 9:
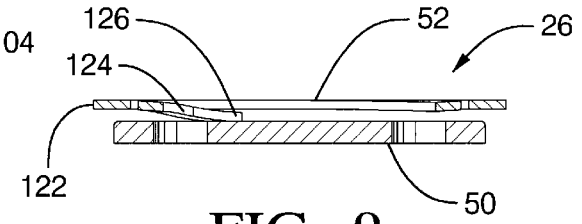
FIG. 9 is a side view of a control valve armature assembly including the guide shim of FIG. 8 and showing the shim fingers flexed as in the closed position of the control valve.

Referring now to FIGS. 8 and 9 of the drawings, a guide shim 52 and an armature assembly 26 including the shim 52 as used in injectors 10 and 94 are illustrated. Assembly 26 (FIG. 9) includes a small diameter magnetically responsive armature disk or control valve disk 50. The disk 50 is fixed to the larger diameter thin flexible metal guide shim 52 (FIG. 8) that includes a peripheral annulus 122. The annulus protrudes radially beyond the edge of the armature disk 50 and is clamped in the housing 14 of the injector between the spacer ring 53 and the flat lower wall 58 of the solenoid assembly 28. Integrally formed with the annulus 122 are resilient fingers 124 that extend arcuately along the inner edge of the annulus to distal ends 126 which are welded to the valve disk 50 at diametrically opposite points. The arrangement of the fingers 124 leaves the center of the disk 50 free from intrusion of the shim 52, which is limited to part of the periphery of the disk.

In use, when the solenoid 28 is energized, the valve disk is attracted to the flat lower wall 58 of the solenoid. However, the resilient fingers 124 contact the wall 58, preventing actual contact by the disk 50. Thus, a clearance is provided between the disk and the solenoid wall 58 equal to the thickness of the fingers 124, which is equal to the shim thickness. Therefore, fuel can flow freely into this clearance between the valve disk 50 and the solenoid wall 58. Accordingly, when the solenoid 28 is again deenergized and the valve disk is forced away from the solenoid 28 by the armature spring 54, fuel freely fills the increasing clearance so that the motion of the disk 50 to close the control valve is not impeded by hydraulic resistance. In other words, the valve is not "stuck" to the solenoid wall 58 by an excessively thin film of fuel which would resist entry of additional fuel between the surfaces and delay closing motion of the valve disk 50.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A fuel injector for the intermittent direct injection of fuel into an engine combustion chamber, said injector comprising:

a housing having a spray tip connected in a fuel injection circuit, the spray tip including a valve seat and at least one discharge orifice;

an injection valve biased against the valve seat but axially movable away from the seat to allow fuel flow through the orifice;

a control chamber in the housing and connected in a fuel control circuit, the fuel injection and fuel control circuits being connectable with a source of high pressure fuel for providing opposing pressures acting against the injection valve from the spray tip in a valve opening direction and from the control chamber in a valve closing direction, the pressures acting to hold the injection valve closed when the opposing pressures are equal;

the control chamber being formed between a cylinder portion fixed in the housing and a piston portion movable with the injection valve between a first position spaced from the cylinder portion wherein the control chamber volume is maximized and a second position engaging the cylinder portion wherein the control chamber volume is minimized, one of said portions including a divider separating the minimized control chamber volume into first and second subvolumes when the portions are engaged;

first and second pressurizing passages in the control circuit and connecting said first and second subvolumes respectively with said pressure fuel source;

a depressurizing passage in said cylinder portion and forming part of the control circuit connected with the second subvolume and controlled by an electrically actuated control valve to block return fuel flow or open the control circuit to fuel return means;

the first pressurizing passage being larger than the second pressurizing passage and smaller than the depressurizing passage such that when the control valve is opened, fuel pressure in the control chamber is quickly relieved, allowing opposing fuel pressure to open the injection valve and force the piston portion into engagement with the cylinder portion, thereby requiring return fuel to pass through the smaller second pressurizing passage and second subvolume, limiting return fuel flow; and when the control valve is again closed, blocking return fuel flow, fuel pressure increases in the second subvolume, thereby separating the cylinder and piston portions and allowing flow through the larger first pressurizing passage to quickly fill the control chamber and force the injection valve to the closed position.

2. A fuel injector as in claim 1 wherein said control valve includes a magnetically responsive armature disk fixed to a thin guide shim, the guide shim including an annular periphery larger than the disk and fixed in said housing and flexible guide fingers within and extending from said periphery to distal ends fixed to the disk for guiding limited motion of the disk between a solenoid and said cylinder portion to unblock or block said depressurizing orifice in open or closed positions of the control valve, respectively, said fingers lying near the annular periphery of the shim between the disc and the solenoid so that engagement of the fingers with the solenoid in an open position of the control valve holds a central portion of the disk spaced from the solenoid, allowing fuel to flow freely between the solenoid and disk upon return movement of the disk to the closed position of the control valve and preventing substantial hydraulic resistance to disk motion away from the solenoid upon closing of the control valve.

3. A fuel injector as in claim 2 wherein said fingers are arcuate and lie essentially parallel to the annular periphery of the shim with said distal ends fixed at annularly equally spaced positions of the disk.

4. A fuel injector as in claim 1 wherein both said pressurizing passages extend in parallel directly from said pressure fuel source to their respective connected subvolumes when the injection valve is fully open, whereby return fuel flow is only through the smaller second pressurizing orifice but, when the control valve is closed, the injection valve is closed by fuel flow through both pressurizing passages to the control chamber.

5. A fuel injector as in claim 4 wherein said divider is formed in a closed configuration such that said first subvolume surrounds said second subvolume when said cylinder and piston portions are engaged.

6. A fuel injector as in claim 5 wherein said divider forms a circular projection on said piston portion.

7. A fuel injector as in claim 1 wherein said second pressurizing passage extends between said first and second subvolumes when the injection valve is fully open, whereby return fuel flows in series through said first and second passages but, when the control valve is closed, the injection valve is closed by fuel flow primarily through the first passage to the control chamber.

8. A fuel injector as in claim 7 wherein said second passage extends through the divider.

9. A fuel injector as in claim 7 wherein said divider is formed in a closed configuration such that the first subvolume surrounds the second subvolume when said cylinder and piston portions are engaged.

10. A fuel injector as in claim 9 wherein said divider forms a circular projection on said piston portion.

* * * * *